United States Patent [19]

Matsuda

[11] 4,161,631

[45] Jul. 17, 1979

[54] PICKUP CARTRIDGE

[75] Inventor: Hitoshi Matsuda, Tokyo, Japan

[73] Assignee: Nippon Columbia Kabushikikaisha, Tokyo, Japan

[21] Appl. No.: 924,354

[22] Filed: Jul. 13, 1978

Related U.S. Application Data

[63] Continuation of Ser. No. 639,189, Dec. 9, 1975, abandoned.

[30] Foreign Application Priority Data

Dec. 13, 1974 [JP] Japan ..... 49-143218

[51] Int. Cl.[2] ..... H04R 9/16

[52] U.S. Cl. ..... 179/100.41 D; 179/100.41 K

[58] Field of Search ..... 179/100.41 D, 100.41 Z, 179/100.41 M, 100.41 K

[56] References Cited

U.S. PATENT DOCUMENTS

| | | | |
|---|---|---|---|
| 2,330,801 | 10/1943 | Abbott | 179/100.41 D |
| 3,299,219 | 1/1967 | Madsen | 179/100.41 K |
| 3,360,616 | 12/1967 | Shiga | 179/100.41 D |
| 3,542,972 | 11/1970 | Braun | 179/100.41 K |
| 3,641,284 | 2/1972 | Westerkamp | 179/100.41 K |
| 3,665,123 | 5/1972 | Ikeda | 179/100.41 M |
| 3,899,827 | 8/1975 | Takami | 179/100.41 D |
| 3,956,598 | 5/1976 | Kawakami | 179/100.41 D |
| 3,963,880 | 6/1976 | Ikeda | 179/100.41 K |

FOREIGN PATENT DOCUMENTS

| | | | |
|---|---|---|---|
| 79385 | 6/1955 | Denmark | 179/100.41 Z |
| 1241633 | 6/1967 | Fed. Rep. of Germany | 179/100.41 K |
| 1000035 | 8/1965 | United Kingdom | 179/100.41 K |

*Primary Examiner*—Bernard Konick
*Assistant Examiner*—Alan Faber
*Attorney, Agent, or Firm*—Hill, Van Santen, Steadman, Chiara & Simpson

[57] ABSTRACT

A pickup cartridge composed of a cantilever, a plate-shaped armature and a magnet or magnetic material. The plate-shaped armature is pivotally mounted to the cantilever and stretched backward by a suspension wire through a damper disposed in front of the magnet or magnetic material. A holding means is disposed at the rear of the damper and includes a magnet with north and south poles. Coils are mounted on the armature. The magnetic flux which passes through the coils passing in the direction of the axes of the coils, but not parallel to the direction determined by a line between the north and south poles of said magnet, produces a linear push-pull output.

2 Claims, 28 Drawing Figures

PICKUP CARTRIDGE

This is a continuation, of application Ser. No. 639,189, filed Dec. 9, 1975, now abandoned.

BACKGROUND OF THE INVENTION

1. Field of the Invention

The present invention relates generally to a moving coil type pickup cartridge, and particularly to a pickup cartridge which can be made small in weight with a magnetic pole being simply constructed and can simultaneously improve magnetic characteristics of an armature.

2. Description of the Prior Art

As a prior art moving coil type pickup cartridge (hereinafter referred to simply as a pickup), a pickup such as shown in FIG. 1 has been disclosed in U.K. patent specification No. 1,000,035 and the like. In this pick-up, a plate-shaped armature 2 is pivotally mounted to a cantilever 1 at its back and wound thereon with left and right coils 3*a* and 3*b* in such a pattern as shown in FIG. 2. The armature 2 is fixed to a magnetic pole 5 with a damper 4 being glued to its back. A suspension wire 7 is fixed at its one end at the inside of a hollow portion 6 of the cantilever 1, while a fixed member 9 is inserted in a spot facing aperture 8 bored in the magnetic pole 5 and this fixed member 9 has provided therein a bore 11 through which a pipe 10 for fixing the other end of the suspension wire 7 is inserted. Reference numeral 12 designates a set screw for fixing the fixed member 9 to the spot facing aperture 8 of the magnetic pole 5. Reference numeral 13 represents another magnetic pole having a bore 14 through which the cantilever 1 is extended. With the prior art pickup as mentioned above, the coils 3*a* and 3*b* on the armature 2 disposed between the magnetic poles 5 and 13 cross the parallel magnetic field therebetween to generate an electromotive force.

However, in the prior art example constructed as described above, if the cantilever 1 is greatly moved laterally or vertically, the cantilever 1 butts against the wall of the bore 14 of the magnetic pole 13 resulting in its breakage. Further, with the magnetic poles of such a configuration it is difficult to form the uniform parallel magnetic field. Therefore, there is a drawback such that if the uniform parallel magnetic field is not formed by the magnetic poles, the crosstalk between right and left channels is increased.

SUMMARY OF THE INVENTION

Accordingly, it is a principal object of this invention to provide a pickup free from the above described drawbacks.

It is another object of this invention to provide a pickup based upon a novel electromotive force generating principle such that the construction of a magnetic pole is simplified and decreased in weight with an armature being not disposed within a parallel magnetic field between magnetic poles; and also non-linearity due to magnetic characteristics of the armature is canceled by push-pull effect to improve its linearity.

The other objects, features and advantages of the present invention will be apparent from the following description taken in conjunction with the accompanying drawings.

DESCRIPTION OF THE PREFERRED EMBODIMENTS

Figure 1:
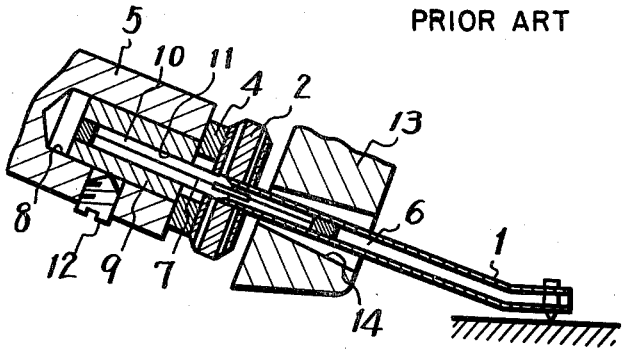
Fig. 1 PRIOR ART
FIG. 1 is a cross-sectional view showing a main portion of a prior art pickup.
Figure 2:
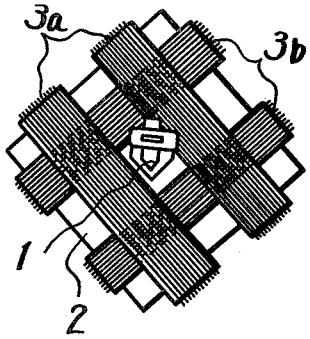
Fig. 2 PRIOR ART
FIG. 2 is a plan view showing an armature used in the pickup of FIG. 1.

A description will hereinbelow be given on one embodiment of this invention with reference to FIGS. 3 and 4, in which elements corresponding to those of FIG. 1 are shown by the same reference numerals with their repeated description being omitted.

Figure 3:
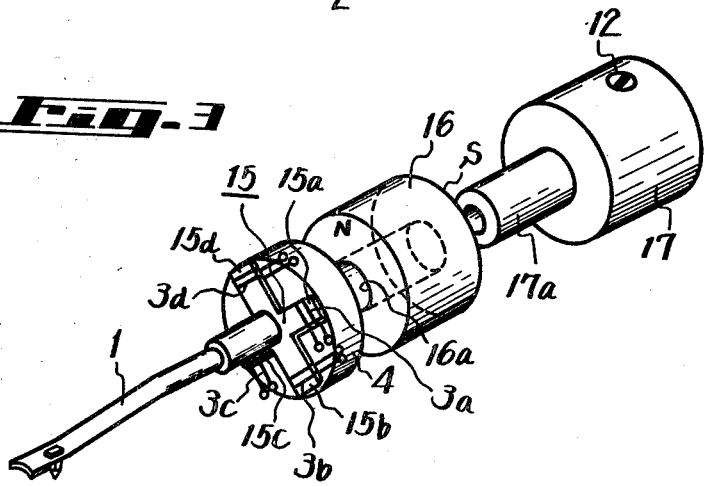
FIG. 3 is an exploded perspective view showing one embodiment of a pickup according to this invention.

In this invention, an armature 15 is formed in substantially a cross shape as shown in FIG. 3, by way of example. Opposite members 15*a* and 15*c* of the armature 15 are respectively wound thereon independently with coils 3*a* and 3*c* having the same number of windings and these coils 3*a* and 3*c* are connected in series. Similarly, the other opposite members 15*b* and 15*d* thereof are also wound thereon independently with the coils 3*b* and 3*d* having the same number of windings and these coils 3*b* and 3*d* are connected in series. The armature 15 wound thereon with these coils 3*a*, 3*b*, 3*c* and 3*d* is attached to an N-pole surface of a ring-shaped magnet 16 through the damper 4. A magnetic material may be used as the ring-shaped magnet 16. In this case, the magnet or magnetic material 16 is provided with a bore 16*a* at its center and magnetized as N-pole at its one end surface and as S pole at its other end surface. Reference numeral 17 denotes a holder consisting of a magnetic material, a magnet or the like. The holder 17 is provided at its center with a projection 17*a* having a diameter which is smaller than that of the center bore 16*a* of the ring-shaped magnet 16 and a length which is substantially equal to that of the ring-shaped magnet 16. Thus, the S-pole surface of the ring-shaped magnet 16 is brought into contact with the holder 17 and hence the top end of the projection 17*a* becomes S pole. Further, as shown in FIG. 4 the pipe 10 for fixing a suspension wire 18 is inserted into the bore 11 formed at the center of the projection 17*a* of the holder 17 and fixed thereto by the set screw 12.

Figure 5A:
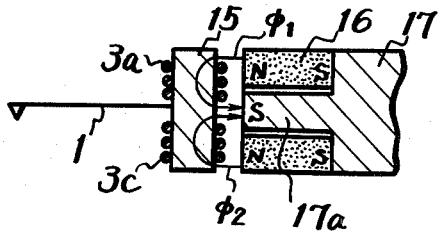
FIGS. 5A, 5B and 5C are cross-sectional views respectively used for explaining the electromotive force generating principle of the pickup according to this invention.
Figure 5B:
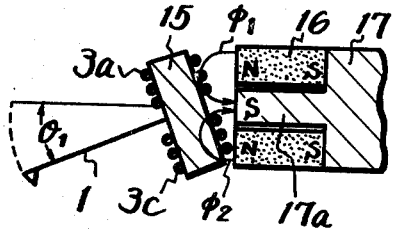
Figure 5C:
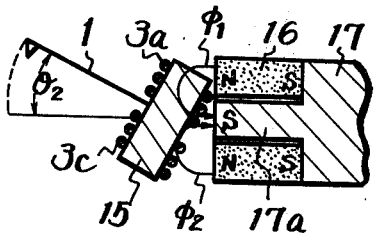
Figure 6:
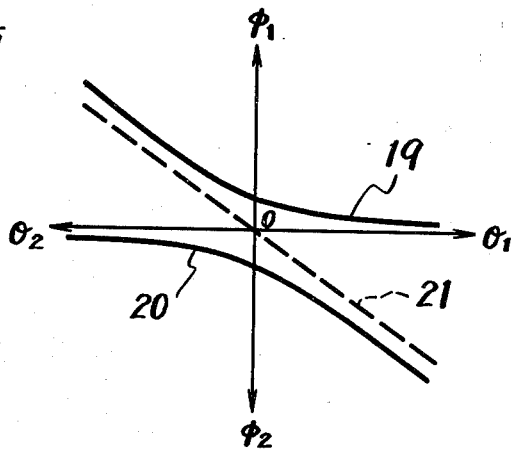
FIG. 6 is a graph showing characteristic curves of inclination of the armature versus magnetic flux passing through the coil of the armature in this invention.

With the above described construction of this invention, the electromotive force generating method will hereinafter be described referring to FIGS. 5A, 5B, 5C and FIG. 6. For the convenience of explanation, an operation of only a single channel of the pickup will be described. FIGS. 5A, 5B and 5C show only the elements relating to the electromotive force generating operation of the pickup. FIG. 5A shows a condition where a stylus of the cantilever 1 is not shifted, and FIGS. 5B and 5C show conditions when the stylus of the cantilever 1 is shifted by angle $\theta_1$ and angle $\theta_2$ from the position shown in FIG. 5A. The coils 3*a* and 3*c* are independently wound on the armature 15 as mentioned above. FIG. 6 shows the variation of magnetic flux passing through the coils 3*a* and 3*c* of the armature 15 when the armature 15 is inclined as shown in FIGS. 5B and 5C. In FIG. 6, the abscissa indicates inclination angles of the cantilever 1 or inclination angles $\theta_1$ and $\theta_2$ of the armature 15 and the ordinate indicates magnetic fluxes $\phi_1$ and $\phi_2$ passing through the coils 3*a* and 3*c*. In this case, the variation of the magnetic fluxes $\phi_1$ and $\phi_2$ is shown by curves 19 and 20, respectively. In other words, when the armature 15 is inclined, the magnetic fluxes $\phi_1$ and $\phi_2$ passing through the armature 15 are increased on the one hand and decreased on the other hand with the center of the armature 15 being made as the borderline. Resultant magnetic flux $\phi$ of those $\phi_1$ and $\phi_2$ is quite superior in linearity as shown by a dotted line 21 in FIG. 6. Therefore, if the coils 3*a* and 3*c* are connected in series to each other, an electromotive force in proportion to the shifting speed of the stylus or the shifting speed of the armature can be produced as an output of the pickup.

Figure 7:
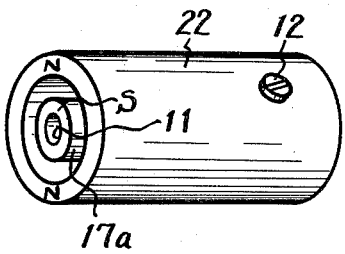
FIG. 7 is a perspective view showing another embodiment of the magnetic pole of this invention.
Figure 8:
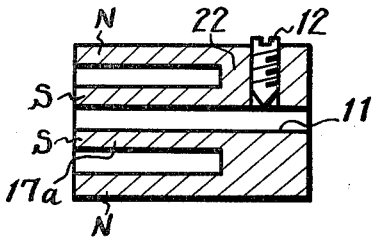
FIG. 8 is a cross-sectional view of the magnetic pole of FIG. 7.

In the first embodiment mentioned above, there are provided the ring-shaped magnet 16 and the holder 17 with the projection 17*a*. Next, another embodiment of the magnetic pole of this invention will be described with reference to FIGS. 7 and 8. FIG. 7 shows a pot-type holder 22 which is formed of a material such as ferrite or the like substantially in pot shape as if the ring-shaped magnet 16 and the holder 17 in the first embodiment are integrally combined. FIG. 8 shows a cross-section of the pot-type holder 22. The outer periphery of the ring portion of the pot-type holer 22 is magnetized as N-pole and the top end of its projection 17*a* as S-pole, thus the same effect as that of the first embodiment being obtainable.

Figure 9:
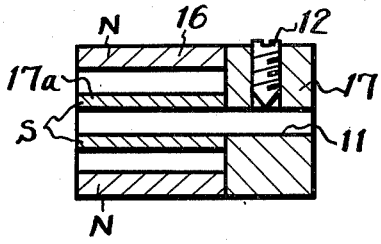
FIG. 9 is a corss-sectional view showing a further another embodiment of the magnetic pole of this invention.

A third embodiment of the magnetic pole is shown in FIG. 9. This embodiment is composed of the combination of the ring-shaped magnet 16, the holder 17 made of magnetic material, and a cylindrical magnet or the projection 17*a* made of magnetic material having the bore 11 at its center as shown in FIG. 9. Of course, in this case, the end surface of the projection 17*a* and the end periphery of the ring-shaped magnet 16, both being opposite to the armature 15, are selected to have magnetic poles which are reverse in polarity to each other as shown in FIG. 9.

Figure 10:
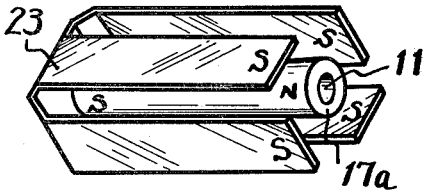
FIGS. 10 and 11 are perspective views respectively showing another embodiments of the magnetic poles of this invention.

FIG. 10 is a perspective view showing a fourth embodiment of the magnetic pole of this invention, in which there is provided a magnetic material 23 having four legs and the projection 17*a* having the bore therethrough is disposed inside the magnetic material 23 at its center.

Figure 11:
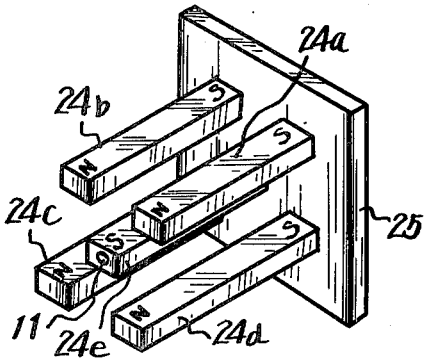

In an embodiment of FIG. 11, four rod-like magnets 24*a*, 24*b*, 24*c* and 24*d*, which are similarly polarized in direction, are planted on a substantially plate-shaped magnetic material 25, and a magnet 24*e* opposite in polarity to these four rod-like magnets 24*a* to 24*d* and having the bore 11 therethrough is planted on the magnetic material 25 at the center among these magnets 24*a* to 24*d*.

Figure 12:
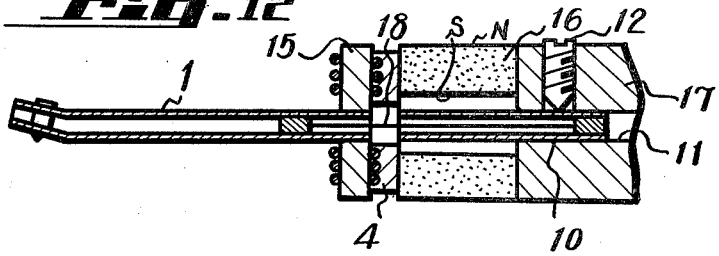
FIG. 12 is a cross-sectional view showing a further embodiment of this invention.
Figure 13:
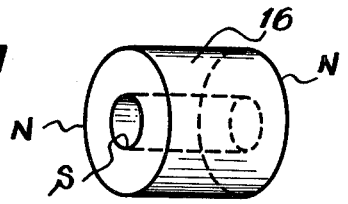
FIG. 13 is a perspective view showing a magnetized condition of the magnetic pole used in the embodiment of FIG. 12.
Figure 14A:
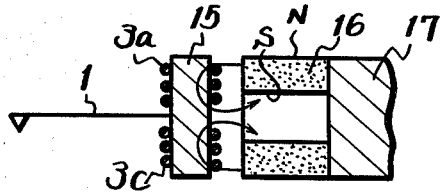
FIGS. 14A, 14B and 14C are cross-sectional views used for explaining the electromotive force generating principle of the embodiment shown in FIG. 12.
Figure 14B:
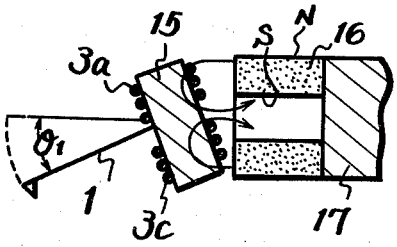
Figure 14C:
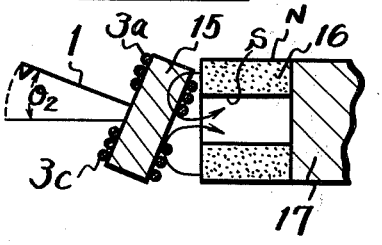

In each of the respective embodiments described above, there is used the pickup to generate an electromotive force based upon the principle shown in FIGS. 5A, 5B and 5C. Meanwhile, as depicted in FIG. 12, only the ring-shaped magnet 16 is used with the aforesaid projection 17*a* being excluded, and the ring-shaped magnet 16 is made as N-pole at its outer periphery and S-pole at its inner periphery as shown in FIG. 13. With the above arrangement, there can be obtained a pickup which operates based upon the principle shown in FIGS. 14A, 14B and 14C similar to that of FIGS. 5A to 5C.

Figure 15:
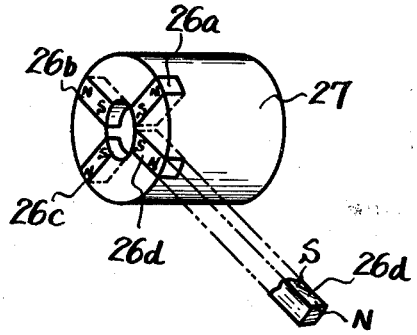
FIG. 15 is a perspective view showing another embodiment of the magnetic pole of this invention.

Further, instead of the above mentioned ring-shaped magnet 16, rod-like magnets 26*a*, 26*b*, 26*c* and 26*d* may be glued to a ring-shaped holder 27 made of a synthetic resin as shown in FIG. 15.

Figure 4:
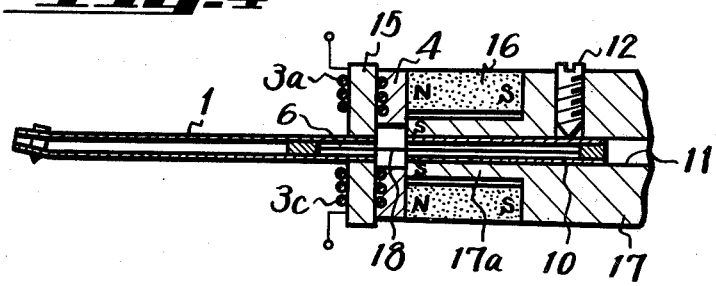
FIG. 4 is a cross-sectional view showing the main part of FIG. 3.
Figure 16:
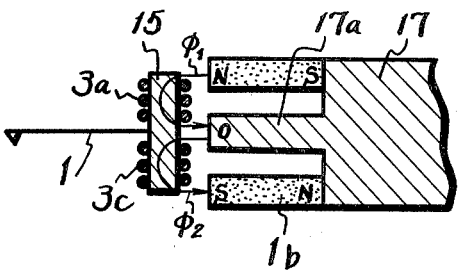
FIG. 16 is a cross-sectional view showing a modified embodiment of FIG. 4.
Figure 17:
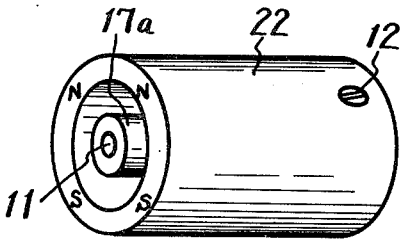
FIG. 17 is a perspective view showing a modified embodiment of FIG. 7.
Figure 18:
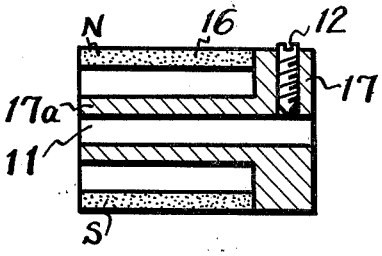
FIG. 18 is a cross-sectional view showing a modified embodiment of FIG. 9.

FIG. 16 shows another embodiment of the magnetic pole of this invention which is a modification of the embodiment of FIG. 4. As shown in FIG. 16, the projection 17*a* of the holder 17 is made neutral in polarity, while the ring-shaped magnet 16 is halved in its axial direction to form upper (or right) and lower (or left) semi-cylindrical magnets 16*a* and 16*b* which are respectively opposed to the holder 17 with their polarities being reversed to each other. Thus, the magnetic flux $\phi_1$ travels from the N pole of, for example, the upper (or right) semi-cylindrical magnet 16*a* to the neutral point O of the projection 17*a* and further the magnetic flux $\phi_2$ travels from the neutral point O to the S pole of the lower (or left) semi-cylindrical magnet 16*b* thereby to cross the coils 3*a* and 3*c* wound on the armature 15. FIG. 17 shows a modified embodiment of FIG. 7, in which the upper (or right) half portion of the pot-type holder 22 is made as N pole and the lower (or left) half portion is made as S pole with the projection 17*a* being made as neutral. FIG. 18 is a modified embodiment of FIG. 9, in which the ring-shaped magnet 16 is divided into upper half portion and lower half portion which are attached to the holder 17 with opposite polarities to each other, or when being magnetized the upper and lower sides of the ring-shaped magnet 16 are made opposite in polarity to each other, and the projection 17*a* made of cylindrical magnet or magnetic material and having the bore 11 at its center is made neutral in polarity.

Figure 19:
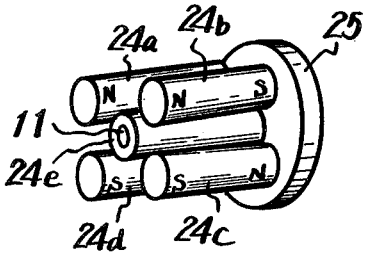
FIG. 19 is a perspective view showing a modified embodiment of FIG. 11.
Figure 20:
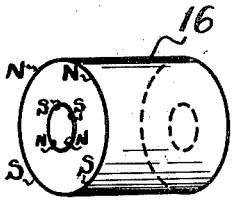
FIG. 20 is a perspective view showing a magnetized condition of the magnetic pole of FIG. 18.
Figure 21:
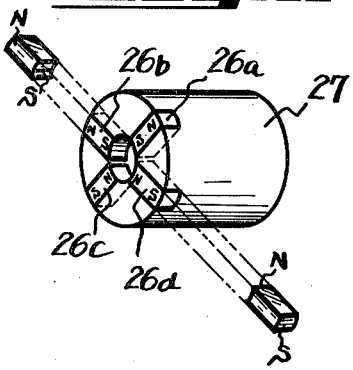
FIG. 21 is a perspective view showing a modified embodiment of FIG. 15.

Further, FIG. 19 is a modification of the embodiment of FIG. 11, in which the end surfaces of the magnets 24*a* and 24*c* and those of the magnets 24*b* and 24*d* are respectively reversed in polarity to each other with that of the magnet 24*e* being made neutral. In an embodiment of FIG. 20, the inner and outer peripheral surfaces of the ring-shaped magnet 16 shown in FIG. 18 are magnetized as illustrated. FIG. 21 is a modified example of FIG. 15 in which the opposing magnets 26*a*-26*d* are respectively made reverse in polarity at their opposite surfaces as illustrated.

Figure 22:
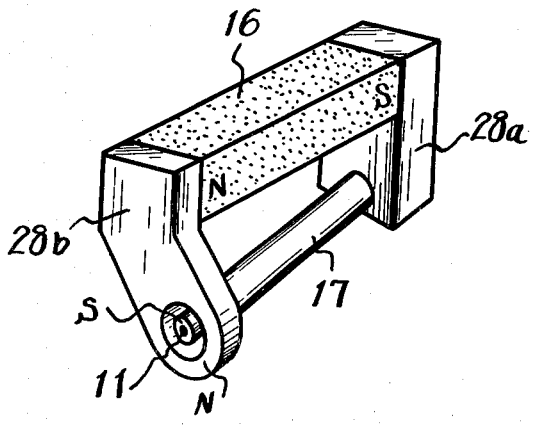
FIG. 22 is a perspective view showing a further embodiment of this invention.
Figure 23:
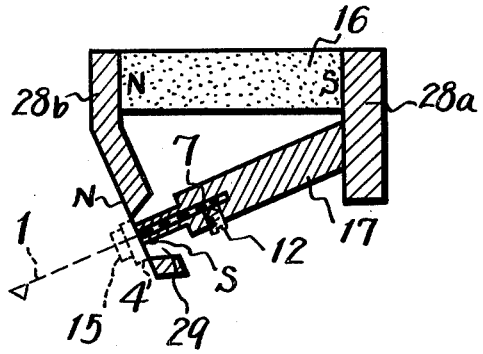
FIG. 23 is a cross-sectional view showing the embodiment of FIG. 22.
Figure 24:
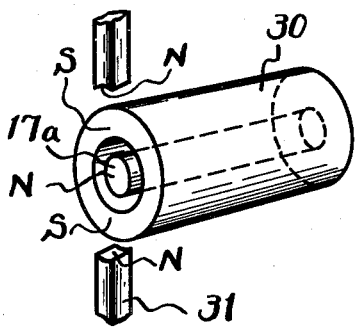
FIG. 24 is a perspective view showing another embodiment of the principal part of FIGS. 22 and 23.

FIGS. 22 and 23 show a further another embodiment of the pickup of this invention. In this embodiment, the magnet 16 is disposed between two magnetic plates 28*a* and 28*b* which are substantially parallel to each other. The holder 17 is provided at the lower side between the magnetic plates 28*a* and 28*b* and supported at the magnetic plate 28*a* in a cantilever mode through an aperture 29 bored at the lower part of the magnetic plate 28*b* which is bent substantially inwardly. With the above arrangement, the vibrating system is inserted through the bore 11 of the holder 17. Further, FIG. 24 shows a modified embodiment of the main part of FIGS. 22 and 23, in which the projection 17*a* is inserted into the bore of a ring-shaped magnetic material 30 which is magnetized as its one end surface as, for example, S pole by a magnet 31 of N pole provided adjacent tthe ring-shaped magnetic material 30. In this case, the end surface of the projection 17*a* is made as N pole.

It is of course possible to select the shape of the aforesaid armature 15 to be rectangular or any. Besides, in the respective embodiments as described above, the magnetic poles N and S may be made reverse to each other.

As the present invention is constructed as mentioned above, any yoke for producing parallel magnetic field as in the prior art is not required and the pickup can be constructed quite compactly in the cantilever support member. Further, since the parallel magnetic field is not formed, the magnetic pole can be made very small in weight such as to be about 1/10 of the prior art one. In addition, as the coils of the armature perform push-pull operation, the magnetic characteristics are superior in linearity and not only the magnetic loss of the armature but also the magnetic distortion can be simultaneously compensated for.

While the principles of the invention have been described above in connection with specific embodiments, and particular modifications thereof, it is to be clearly understood that this description is made only by way of example and not as a limitation on the scope of the invention.

I claim as my invention:

1. A pickup cartridge comprising:

a cantilever, a cross-shaped armature with four legs attached to said cantilever, a damper attached to said armature, a suspension wire means for supporting said cantilever and said armature and extending through said damper, holding means disposed at the rear of said damper and including at least a magnet with north and south poles, said suspension wire means being attached thereto, and electromagnetic pickup means including axially aligned first and second coils of the same number of turns connected in series mounted on first and second axially aligned legs of said armature, third and fourth coils of the same number of turns connected in series mounted on third and fourth axially aligned ledgs of said armature, said first and second coils aligned at 90 degrees to said third and fourth coils, said armature being disposed such that magnetic flux generated by said magnet and passing through said armature is varied when the distance between the four legs of said armature and said magnet is changed so as to induce a voltage in said first, second, third and fourth coils wound on said armature, said magnetic flux which passes through said coils passing in the direction of the axes of said coils and being not parallel to the direction determined by a line between the north and south poles of said magnet and said first coil moving toward said magnet when said second coil moves away from said magnet and said third coil moving toward said magnet when said fourth coil moves toward said magnet to produce a linear push-pull output.

2. A pickup cartridge comprising:

a cantilever, a cross-shaped armature with four legs attached to said cantiliever, a suspension wire means for supporting said cantilever and said armature, a damper through which said wire extends, holding means disposed at the rear of said damper and including at least a magnet with north and south poles, said suspension wire means being attached thereto, an electromagnetic pickup including axially aligned first and second coils of the same number of turns connected in series and mounted on first and second axially aligned legs of said armature, third and fourth coils of the same number of turns connected in series mounted on third and fourth axially aligned legs of said armature, said first and second coils aligned 90 degrees to said third and fourth coils, said armature being disposed such that magnetic flux generated by said magnet and passing through said armature is varied when the distance between the four legs of said armature and said magnet is changed so as to produce a voltage in said first, second, third and fourth coils wound on said armature, said magnetic flux which passes through said coils passing in the direction of the axes of said coils and being not parallel to a line between the north and south poles of said magnet and said first coil moving toward said magnet when said second coil moves away from said magnet, and said third coil moving toward said magnet when said fourth coil moves toward said magnet to push a linear produce-pull output, and wherein the holding means comprises a substantially ring-shaped member having a central bore and a holder having a projection, the projection of the holer passing within the central bore of the ring-shaped member.

* * * * *